US005551870A

United States Patent [19]

Gale

[11] Patent Number: 5,551,870

[45] Date of Patent: Sep. 3, 1996

[54] ROTATING KILN SEAL

[75] Inventor: Charles O. Gale, Bountiful, Utah

[73] Assignee: Summit Valley Equipment and Engineering, Salt Lake City, Utah

[21] Appl. No.: 351,663

[22] Filed: Dec. 8, 1994

[51] Int. Cl.[6] ..... F27B 7/24

[52] U.S. Cl. ..... 432/115; 432/103; 432/120; 34/108; 34/242

[58] Field of Search ..... 34/108, 242; 432/103, 432/115, 120

*Primary Examiner*—Henry A. Bennett

*Assistant Examiner*—Siddmarth Ohri

*Attorney, Agent, or Firm*—A. Ray Osburn

[57] ABSTRACT

A rotating seal device for a rotary drum kiln. A rotating seal member is welded about the drum near each of its ends, each sealing against a rotationally stationary seal member joined with the associated kiln end hood through a flexible gas tight bellows. The stationary seal rides on a pair of rollers each bearing upon a track, preventing its rotation. The bellows accommodates longitudinal expansion and contraction of the drum. Hanging weights are used with pulley wheels and flexible cables to urge the non-rotating members against the rotating members with unvarying force.

10 Claims, 2 Drawing Sheets

ROTATING KILN SEAL

BACKGROUND OF THE INVENTION

1. Field

This invention relates to devices for sealing of rotating drum kilns against entry of atmospheric air, and more specifically to rotating seals for that purpose. Still more specifically the invention relates to such seals for kilns utilized to regenerate spent activated carbon.

2. State of the Art

"Activated" carbon is used in many chemical processes for absorption of materials, such as are often contained in liquid solutions. With repeated use, the carbon becomes saturated with the contaminant and loses its ability to absorb it. In this event, the carbon is no longer activated and must either be discarded or reactivated to remove the unwanted contaminants from the surface of the carbon and its pore structure. To reactivate such carbon, it is heated to high temperatures, ranging from 550° C. to 800° C., in air or in a steam rich atmosphere. Efficient treatment of the spent carbon requires it to be turned and tumbled, to provide access of the heat and steam to all of the carbon and all of its pores. This is typically done in a kiln having a rotating drum into which the carbon to be treated is fed. In some installations, steam is injected, along with fuel and air for internal heat producing combustion. In others, a portion of the exterior of the drum is heated in an oven, and steam may be provided by feeding the carbon in a damp condition and allowing the resultant steam to enrich the atmosphere the full length of the drum.

Regardless of the type of rotating kiln used, a tubular drum rotates to tumble the contents, which are generally granular in form, to provide even heating for most efficient treatment. The drum is installed at a downward slope from an inlet end to an outlet end. Baffles on the inside of the drum wall help achieve even tumbling and even heating.

The rotating drum joins with an inlet end and an outlet end stationary hood structure, the former mounting material feed apparatus. The outlet end hood directs outlet gases, primarily steam, from the drum to the atmosphere, and is connected to treated material collection containers. The junctures of rotating drum inlet and outlet ends with the associated stationary hoods requires a rotary mechanical seal device, to preclude entry of unmetered atmospheric air into the drum interior. Such incursion could result in burning of the carbon being treated. Also, maintenance of the temperature of the internal steam atmosphere required for efficient reactivation would be difficult without effective atmospheric seals.

A rotating seal component on each end of the drum must bear against a stationary seal member connected to the adjacent stationary hood. This requires mechanical seals having mating rotating and stationary annular bearing surfaces, diametrially even larger than the drum. Providing substantially constant pressure between the bearing faces is complicated by the expansion and contraction of the drum both longitudinally and diametrally with change of operating oven temperature.

In prior art seal design is, the stationary seal component is generally fixed to the respective hood, and cannot move longitudinally or diametrally to the drum. The rotating seal component, however, is joined to the outside circumference of the drum by a non-metallic membrane allowing the drum to expand and contract while the rotating seal component remains in contact with its stationary counterpart. The rotating seal member is oversized in diameter to allow for diameter increase of the drum. With this arrangement, the rotating component must itself be sealed against entry of air. Pressure between the fixed and turning seal faces is maintained by compression springs acting between a flange welded to the drum and the turning seal component. Other arrangements may employ tension springs. In either event, the spring induced normal force between the seal components must vary substantially with drum expansion and contraction, because of associated variation in spring force with length. Another shortcoming is leak producing tilting or cocking of the rotating seal, which must often float loosely upon the connecting membrane. Normal face contact pressure of the seal elements will also decrease with wear of the faces, or wear plates if employed, with prolonged use.

A critical need therefore remains for a rotary sealing device which reliably compensates for longitudinal and diametral expansion and contraction of the rotating drum, to reliably prevent the intrusion of unwanted air into the interior of the rotating drum of the kiln.

BRIEF SUMMARY OF THE INVENTION

With the foregoing in mind, the present invention eliminates or substantially alleviates the shortcomings and disadvantages in prior art methods and apparatus for sealing against the intrusion of ambient air into rotating drum kilns. The inventive seal comprises a rotating component in the form of a metallic flange welded circumferentially about an associated end of the rotating drum. Said flange carries on its hood facing side a machined annular rotating sealing surface. The rotating sealing member bears against a replaceable wear plate carried by a stationary metallic seal member which loosely girdles the rotating drum, providing clearance for variation in diametral envelope of the drum occurring with large oven temperature changes. The stationary seal plate is mounted to a bellows of fiberglass or other heat resistant material, which also loosely girdles the drum. The bellows is in turn secured at its opposite end to still another circumferentially disposed metallic plate, secured in this instance to the adjacent side of the associated end hood. Both longitudinal and radial expansion and contraction of the rotating drum are completely compensated in this arrangement. The bellows remains loose regardless of the expansion and contraction of the kiln drum, wrinkling to accommodate expansion. To assure that no torque is applied to the bellows, the rotating seal member carries a pair of opposed horizontal spindles mounting a pair of roller wheels, which in turn ride upon a pair of stationary tracks secured, for example, to the associated end hood. It is evident that the "stationary" seal component shifts longitudinally, although not rotationally. Substantially invariant sealing pressure between the stationary and rotating seal surfaces is achieved by individual hanging weights each connected by a flexible cable guided by a pulley wheel spindled to rotate in a fixed location, to pull the stationary seal into contact with the rotating seal. The sealing pressure is substantially constant although the rotating seal plate location varies greatly with drum expansion and contraction. Preferably, these devices are provided, with identical weights, at two opposed positions, and at a lowermost position directly beneath the rotating drum. If desired, additional or differently distributed locations may be utilized.

Such seal arrangements must be provided both at the discharge hood and at the entrance hood, both of which must be protected from incursion of external atmosphere into the rotating drum. A shortened bellows may be used at the entrance end of the drum however, because the drum is mounted to hold an encircling rotation drive gear in stationary longitudinal position quite near the entrance end.

It is therefore the principal object of the present invention to provide an improved seal design for rotating drum kilns, incorporating means for assuring constant seal pressure and reliable sealing between the drum and the atmosphere.

BRIEF DESCRIPTIONS OF THE DRAWINGS

In the drawings, which represent the best modes presently contemplated for carrying out the invention, FIG. 1 is a side elevation view of a rotary kiln installation incorporating the rotating kiln seal in accordance with the invention at each end of its rotating drum, the installation being shown fragmentally, drawn to a reduced scale, FIG. 2 a vertical cross sectional view taken along line 2—2 of FIG. 1, drawn to a reduced scale larger than that of FIG. 1, and FIG. 3 a horizontal sectional view of a fragment of the rotary kiln of FIG. 2, taken along line 3—3 thereof, drawn to a reduced scale larger than that of FIG. 2.

DETAILED DESCRIPTION OF ILLUSTRATED EMBODIMENTS

Figure 1:
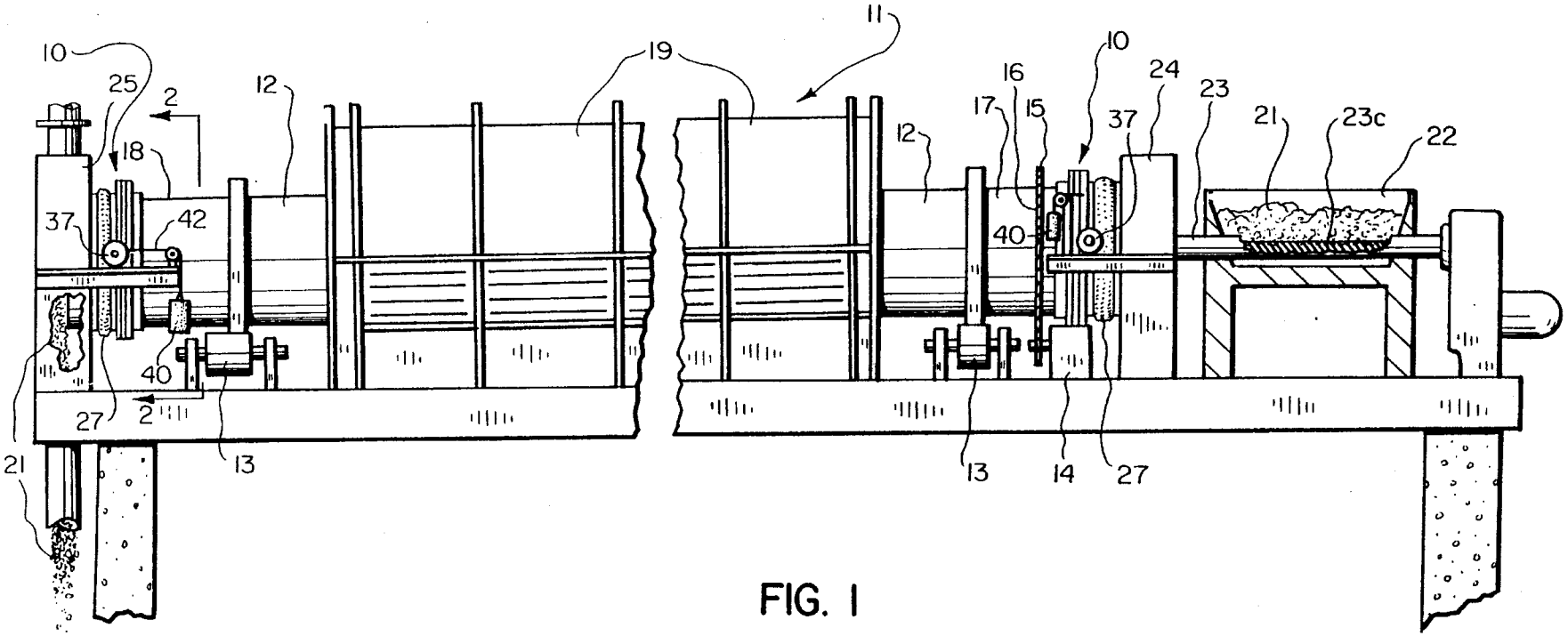
Figure 2:
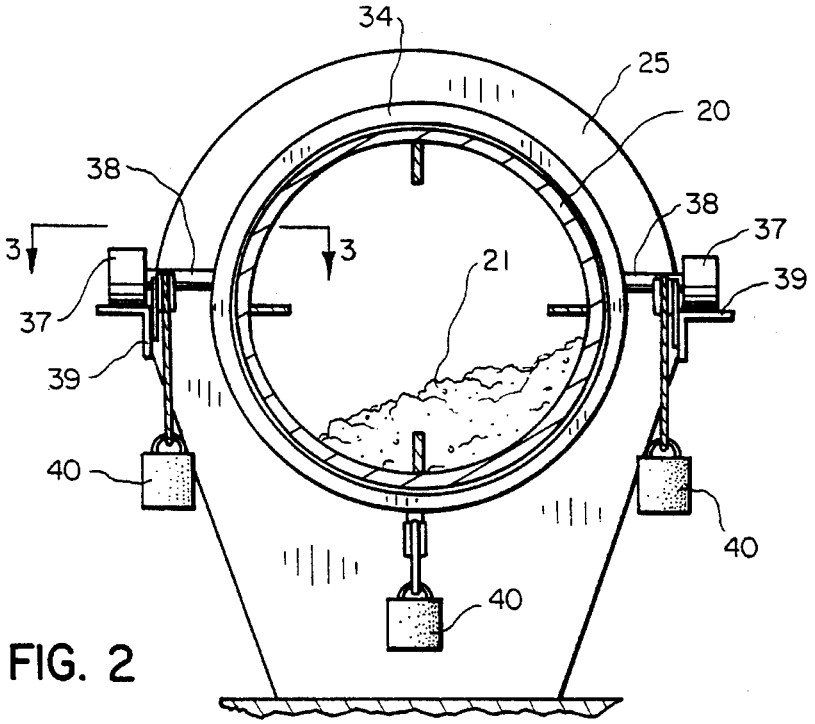
Figure 3:
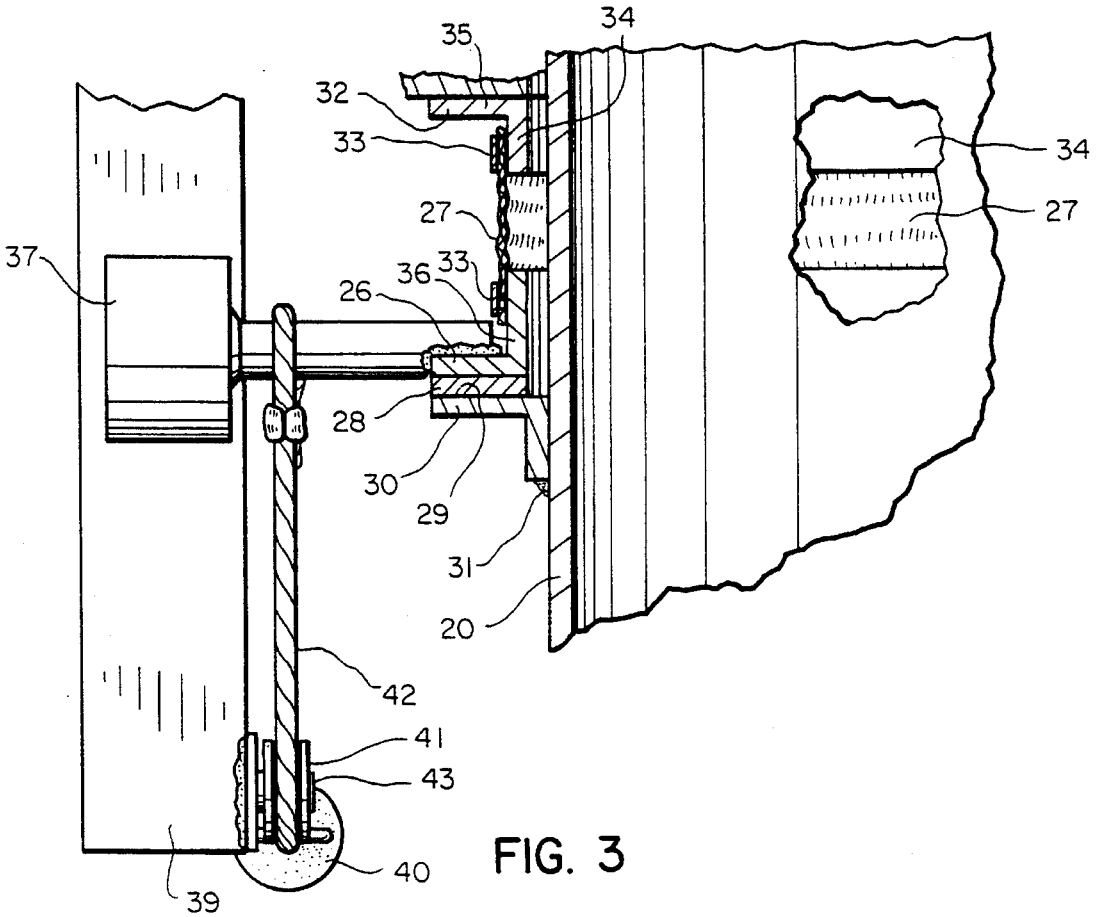

Rotary seals 10 are employed in a rotating drum kiln installation 11 seen in FIG. 1. An elongate steel drum 12 is mounted to rotate upon longitudinally spaced trundles 13, powered by a motor 14 through a chain 15 and a drum encircling cog gear 16. Drum 12 slopes from an inlet end 17 downwardly to an outlet end 18, with its central section inside a furnace 19 which heats the drum through exterior shell 20. (FIG. 2) However, other, direct fired, kilns may be heated with internal combustion within the drum, with fuel and air injected into its inlet end, and combusted to provide the necessary heat. With the indirect fired kiln heating approach, unwanted ambient air must be excluded from entering into the drum, so as to not upset the gaseous balance within the kiln. Too much unplanned internal air can result in unwanted combustion with indirect fired kilns. With kilns used to regenerate activated carbon, the carbon being treated may itself be destroyed by this unwanted combustion.

As indicated in FIG. 1, carbon 21 to be treated is placed into a feed bin 22 communicating with the drum inlet end 17 by way of a feed tube 23 through an inlet end hood 24. A helical screw conveyor 23*c* may be used.

Unwanted air is excluded by rotating seal assemblies 10 at the junctures of drum 12 with stationary inlet and outlet hoods 24 and 25 respectively. Both seals 10 must cope with substantial longitudinal and diametral expansion and contraction of drum 12, large portions of which is often heated to near 1,500° F.

Each of the rotating seal assemblies 10 comprises a non-rotating member 26 joined to the facing side of the associated inlet or outlet hood through a flexible bellows 27. Stationary member 26 carries a wear plate 88 in sealing contact with an annular sealing surface 29 on a rotating component 30 secured to drum 12 by weld 31. Rotating component 30 moves back and forth with expansion and contraction of drum 12, followed by stationary seal component 26, with bellows 27 folding and unfolding as necessary. Bellows 27 is secured, as by steel banding 33, to leg 34 of hood mounted flange 35, and to cylindrical leg 36 of stationary seal 26. Bellows 27 is preferably of fiberglass cloth, capable of withstanding elevated temperatures, although largely isolated from high drum temperatures. Seal member 26 is maintained rotationally stationary and longitudinally movable by a pair of dolly rollers 37 each on a horizontal spindle 38 affixed as by welding to said seal member. Each roller 37 bears on a stationary longitudinal track 39 affixed to the associated end hood.

The non-rotating wear plate 28 is typically of brass, relatively soft to abrade into a smooth annular sealing surface, which mates with a smoothly ground annular area on rotating member 30. However, for efficient sealing during drum expansion and contraction, substantially constant interface pressure force must be maintained between the stationary wear plate and the mating face of the rotating seal member. A hanging weight 40, a pulley wheel 41 and a flexible cable 42 combine to provide interface pressure which does not vary with varying seal position. Pulley wheel 41 turns about a spindle 43 secured, for example, to stationary dolly wheel track 39. Cable 42 is attached to non-rotating seal member 26 through dolly wheel spindle 38, for example. The constant tension in cable 42 from weight 40 translates into constant seal interface pressure regardless of longitudinally varying seal position.

At least three weight/pulley wheel assemblages should be used, distributed preferably evenly about the circumference of each seal. In one satisfactory arrangement, the assemblages are provided diametrally opposite near the horizontal mid plane of drum 12, with another appended at the central lowermost point of the seal.

Diametral expansion and contraction of drum 12 is reflected in similar expansion of rotating seal 30, but is of lower magnitude, and is accommodated without substantial effect. Mating sealing areas are not changed significantly, nor is the face-to-face sealing pressure.

The invention may be embodied in still other specific forms without departing from the spirit or essential characteristics thereof. The present embodiments are, therefore, to be considered as illustrative and not restrictive, the scope of the invention being indicated by the appended claims rather than by the foregoing description, and all changes that come within the meaning and range of equivalency of the claims are, therefore, intended to be embraced therein.

What is claimed and desired to be secured by United States Letters Patent is:

1. In a kiln installation including an elongate cylindrical drum having a longitudinal axis of symmetry and extending between and joining stationary inlet and outlet end hood structures, means for rotating the drum about said axis, and means for creating and maintaining the interior of the drum at selected elevated temperatures without combustion therewithin, a device sealing against entry of atmospheric air into the interior of the kiln installation at each end of the rotating drum, said devices each comprising:

a rotating seal member welded sealably around the outside surface of the drum, carrying an annular sealing surface facing toward an adjacent end of the drum;

a non-rotating seal member sized to clearingly encircle the drum at all temperatures thereof, having an annular sealing surface facing and in sealing contact with the rotating sealing surface;

a flexible bellows member of gas-impervious material, and means sealably securing said bellows member clearingly encircling the drum and spanning longitudinally between the non-rotating seal member and a near side of an associated end hood;

means preventing rotation of the non-rotating sealing member during rotation of the drum; and means urging the sealing surface of the non-rotating sealing member with unvarying force into sealing contact with the sealing surface of the rotating seal member, at all expanded and contracted conditions of the drum.

2. The sealing device of claim 1, wherein the means urging the sealing surfaces together includes a multiplicity of assemblages distributed spaced apart about the non-rotating seal member, each assemblage comprising:

a hanging weight;

an elongate flexible member connecting the weight to the non-rotating seal member;

a pulley wheel rotating about a stationary spindle positioned to guide the flexible member so that the tension therein urges the sealing surface of the non-rotating seal member normally against the sealing surface of the rotating seal member.

3. The sealing device of claim 2, wherein:

a pair of assemblages is installed generally along the horizontal diameter of the non-rotating seal member on opposite sides thereof; and an additional assemblage is placed to act generally at the lowermost point of the non-rotating sealing member.

4. The sealing device of claim 1, wherein the means preventing sealing member rotation comprises:

a pair of assemblages placed on horizontally opposite sides of the non-rotating seal member, each assemblage comprising:

an elongate horizontal track secured to the associated hood structure and running parallel to the drum;

a dolly wheel positioned to roll along the track; and a dolly wheel spindle fixed horizontally outstanding from the non-rotating seal member.

5. The sealing device of claim 2, wherein the means preventing sealing member rotation comprises:

a pair of assemblages placed on horizontally opposite sides of the non-rotating seal member, each assemblage comprising:

an elongate horizontal track secured to the associated hood structure and running parallel to the drum;

a dolly wheel positioned to roll along the track; and a dolly wheel spindle fixed horizontally outstanding from the non-rotating seal member.

6. The sealing device of claim 1, wherein:

the flexible bellows material is fiberglass cloth.

7. The sealing device of claim 5, wherein:

the flexible bellows material is fiberglass cloth.

8. The sealing device of claim 1, wherein the non-rotating seal member comprises:

a steel ring member to which the bellows is attached; and a wear plate of softer metal attached to the steel ring member and carrying the annular sealing surface.

9. The sealing device of claim 5, wherein the non-rotating seal member comprises:

a steel ring member to which the bellows is attached; and a wear plate of softer metal attached to the steel ring member and carrying the annular sealing surface.

10. The sealing device of claim 9, wherein:

the material of the wear plate is brass.

* * * * *